US012734412B2

(12) United States Patent
Hope et al.

(10) Patent No.: US 12,734,412 B2
(45) Date of Patent: Sep. 15, 2026

(54) GOLF CLUB ALTERNATIVE FITTING SYSTEM

(71) Applicant: KARSTEN MANUFACTURING CORPORATION, Phoenix, AZ (US)

(72) Inventors: Alex J. Hope, London (GB); Erik M. Henrikson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 962 days.

(21) Appl. No.: 17/819,183

(22) Filed: Aug. 11, 2022

(65) Prior Publication Data

US 2024/0050813 A1 Feb. 15, 2024

Related U.S. Application Data

(63) Continuation of application No. 16/226,425, filed on Dec. 19, 2018, now Pat. No. 11,413,507.

(60) Provisional application No. 62/607,459, filed on Dec. 19, 2017.

(51) Int. Cl.

| | |
|---|---|
| ***A63B 53/02*** | (2015.01) |
| ***A63B 53/04*** | (2015.01) |
| ***A63B 60/00*** | (2015.01) |
| ***A63B 69/36*** | (2006.01) |
| ***A63B 102/32*** | (2015.01) |

(52) U.S. Cl.

CPC ..... *A63B 53/02* (2013.01); *A63B 53/047* (2013.01); *A63B 60/00* (2015.10); *A63B 69/36* (2013.01); *A63B 2102/32* (2015.10)

(58) Field of Classification Search

CPC ..... A63B 53/02; A63B 53/047; A63B 60/00; A63B 69/36; A63B 2102/32; A63B 53/023

See application file for complete search history.

(56) References Cited

U.S. PATENT DOCUMENTS

| | | | |
|---|---|---|---|
| 1,650,183 | A | 11/1927 | Brooks |
| 3,524,646 | A | 8/1970 | Wheeler |
| 5,316,297 | A | 5/1994 | Chappell |
| 5,540,435 | A | 7/1996 | Kawasaki |

(Continued)

FOREIGN PATENT DOCUMENTS

| | | |
|---|---|---|
| JP | 2006034906 | 2/2006 |
| JP | 2007143904 | 6/2007 |

(Continued)

OTHER PUBLICATIONS

International Search Report of the International Searching Authority for International Application No. PCT/US2018/066586 filed Mar. 22, 2019.

*Primary Examiner* — Jeffrey S Vanderveen

(57) ABSTRACT

The invention is an alternative fitting system for golf clubs including an adapted production head with a threaded hosel and a shaft sleeve adapter and a compression nut. The shaft sleeve adapter is permanently adhered to a golf club shaft. The compression nut holds together the shaft sleeve adapter and the threaded hosel of the club head. Alignment notches on the threaded hosel and alignment features on the shaft sleeve adapter prevent unwanted rotation. Furthermore, some embodiments of the shaft sleeve adapter comprise an angled bore hole, which allows for various loft and lie configurations.

16 Claims, 14 Drawing Sheets

(56) References Cited

U.S. PATENT DOCUMENTS

| | | | | |
|---|---|---|---|---|
| 5,653,645 | A | 8/1997 | Baumann | |
| 5,885,170 | A | 3/1999 | Takeda | |
| 6,039,659 | A | 3/2000 | Hamm | |
| 6,110,055 | A | 8/2000 | Wilson | |
| 6,475,097 | B2 | 11/2002 | Liao | |
| 6,890,269 | B2 | 5/2005 | Burrows | |
| 7,115,046 | B1 | 10/2006 | Evans | |
| 7,207,897 | B2 | 4/2007 | Burch | |
| 7,226,364 | B2 | 6/2007 | Helmstetter | |
| 7,354,353 | B2 | 4/2008 | Hocknell | |
| 7,427,239 | B2 | 9/2008 | Hocknell | |
| 7,566,279 | B2 | 7/2009 | Nakashima | |
| 7,699,717 | B2 | 4/2010 | Morris | |
| 7,704,158 | B2 | 4/2010 | Burrows | |
| 7,722,474 | B2 | 5/2010 | Thomas | |
| 7,789,766 | B2 | 9/2010 | Morris | |
| 7,789,769 | B2 | 9/2010 | Sugimoto | |
| 7,878,921 | B2 | 2/2011 | Bennett | |
| 7,931,542 | B2 | 4/2011 | Kusumoto | |
| 7,955,183 | B2 | 6/2011 | Burrows | |
| 7,955,185 | B2 | 6/2011 | Tavares | |
| 7,980,959 | B2 | 7/2011 | Morris | |
| 8,133,130 | B2 | 3/2012 | Morris | |
| 8,235,834 | B2 | 8/2012 | De La Cruz | |
| 8,235,835 | B2 | 8/2012 | Soracco | |
| 8,235,838 | B2 | 8/2012 | Burrows | |
| 8,360,897 | B2 | 1/2013 | Morris | |
| 8,449,404 | B2 | 5/2013 | Thomas | |
| 8,545,344 | B2 | 10/2013 | De La Cruz | |
| 8,562,454 | B2 | 10/2013 | Burch | |
| 8,727,905 | B2 | 5/2014 | Murphy | |
| 8,939,877 | B2 | 1/2015 | Waldrop | |
| 9,033,815 | B2 | 5/2015 | Sander | |
| 9,403,067 | B2 | 8/2016 | Zimmerman | |
| 9,522,308 | B2 | 12/2016 | Sander | |
| 9,724,572 | B2 | 8/2017 | Mizutani | |
| 9,757,627 | B2 | 9/2017 | Galvan | |
| 9,993,698 | B2 | 6/2018 | Tassistro | |
| 2003/0186755 | A1 | 10/2003 | Kitabayashi | |
| 2008/0254908 | A1* | 10/2008 | Bennett | A63B 53/02 473/307 |
| 2009/0011848 | A1 | 1/2009 | Thomas | |
| 2009/0062026 | A1 | 3/2009 | Cho | |
| 2011/0111881 | A1 | 5/2011 | Sander | |
| 2012/0010014 | A1 | 1/2012 | Morris | |
| 2012/0225729 | A1* | 9/2012 | Burch | A63B 60/00 473/307 |
| 2013/0281224 | A1 | 10/2013 | Zabala Scharpp | |
| 2019/0192924 | A1* | 6/2019 | Hope | A63B 53/02 |

FOREIGN PATENT DOCUMENTS

| | | |
|---|---|---|
| JP | 2008167837 | 7/2008 |
| JP | 2009268597 | 11/2009 |
| JP | 2012152331 | 8/2012 |

* cited by examiner

GOLF CLUB ALTERNATIVE FITTING SYSTEM

This is a continuation of U.S. application Ser. No. 16/226,425 filed Dec. 19, 2018, which claims the benefit of U.S. Provisional Application No. 62/607,459 filed Sep. 19, 2017, all the contents of which are incorporated fully herein by reference.

TECHNICAL FIELD

This disclosure relates generally to golf clubs and relates more particularly to a golf club fitting system.

BACKGROUND

In general, golf clubs are manufactured to have a relatively permanent shaft length, loft angle, lie angle, and other parameters. Golf players generally perform best when using a golf club that is designed with specific parameter values to suit their individual swing pattern and stature. Assisting players with selecting the correct specifications for a golf club is often called "fitting." The fitting process requires allowing the player to try various different combinations of shaft length, weighting, loft angle, lie angle, and other parameters. Due to the great number of possible options, it is effective and efficient to have a fitting system that allows alternating parameter combinations during the fitting process. For example, often this process of alternating parameter combinations includes coupling a certain club head to a certain shaft or exchanging a lighter swing weight for a heavier swing weight. Primary factors of importance in fitting systems include ergonomics, simplicity, durability, and aesthetics.

The golf club head or system for fitting is often referred to as an alternative fitting system (hereafter "AFS"). Alternative fitting systems (AFSs) are used to try out different lies and lofts of golf club heads to best match a golfer's swing. Golf clubs having large variety of shaft length, lie, and loft specifications can be constructed from a single, compact AFS. Manufacturing existing AFS systems requires custom producing club heads that can engage the shafts of the AFS. Other AFS systems require a hosel adaptor component that is attached to a club head to make the club head compatible with the shafts of the AFS. Manufacturing custom club heads for an AFS is costly and inefficient. Furthermore, systems requiring a hosel adaptor can be heavier and bulkier, and can require more manufacturing steps. There is a need in the art for an alternative fitting system (AFS) that can be cost-effectively manufactured, while also having realistic weighting that matches production golf clubs.

BRIEF DESCRIPTION OF THE DRAWINGS

To facilitate further description of the embodiments, the following drawings are provided in which.

Figure 1:
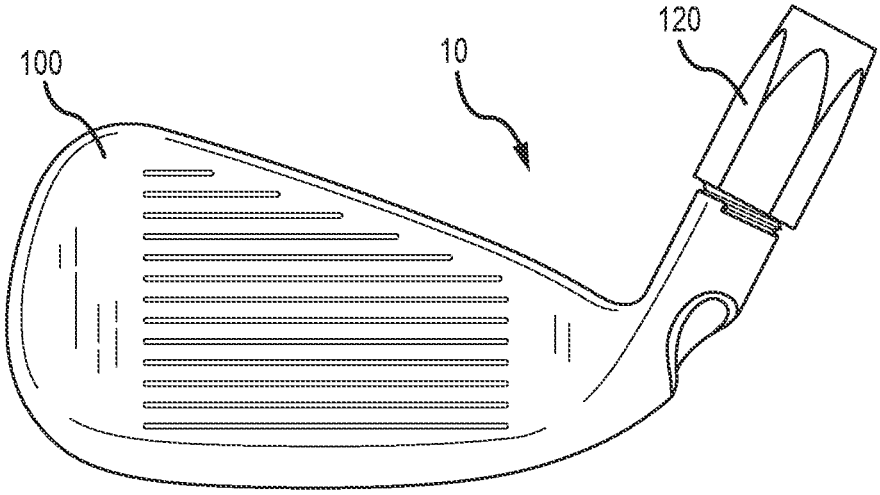
FIG. 1 illustrates a front view of an alternative fitting system assembly, comprising a golf club head with a threaded hosel, a shaft sleeve adaptor, and a compression nut.

The inventors have newly discovered an alternative fitting system (AFS) having a simplistic design that adapts production club heads for use in a fitting system. The alternative fitting system (AFS) comprises a golf club shaft, a shaft sleeve adapter, and a compression nut to fit a production club head. The shaft sleeve adapter is adhered to the golf club shaft, and serves to align and secure the shaft to the golf club hosel. A compression nut releasably secures the shaft sleeve adapter to the modified hosel through a threaded connection. Avoiding the use of a hosel adapter and other components reduces the production cost, and lessens the chance of failure. The reduced chance of failure is achieved by the simplicity of a limited number of components. Also, the small number of components decreases the stress risers amongst the secured pieces. Furthermore, limiting the number of components to only the most critical components reduces the weight of the adjustable golf club, thus giving it weight characteristics that provide a realistic feel to a golf club for the golfer during a fitting. Finally, using production club heads for the fitting system also reduces the cost of manufacturing a fitting system.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

DESCRIPTION

Described herein is a golf club head or set of golf club heads that can be used for fitting a golfer according to their swing characteristics using production club heads instead of manufacturing specific golf club heads only for the alternative fitting system (hereafter "AFS"). The AFS discovered by the inventors comprises an adapted production golf club head, a shaft, a shaft sleeve adaptor, and a compression nut that is fitted to the threaded production hosel. The AFS can include loft and lie adjustability. In one embodiment, the production heads of the AFS comprise a threaded hosel to receive the compression nut, which is held to the shaft by a shaft sleeve adaptor. By making use of threaded production club heads instead of custom-made club heads, the AFS can significantly lower manufacturing production time for the AFS, reduce stress risers by limiting the number of components, lower cost, improve aesthetics, improve tolerances, save weight, and provide the golfer a more accurate fitting.

Figure 2:
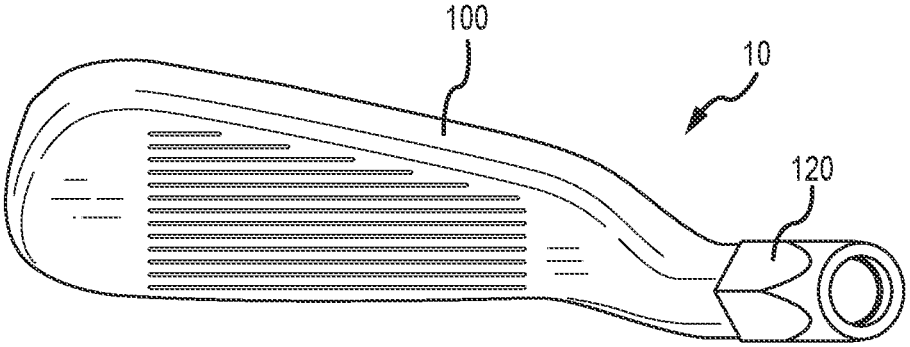
FIG. 2 illustrates an top view of the alternative fitting system assembly of FIG. 1.
Figure 3:
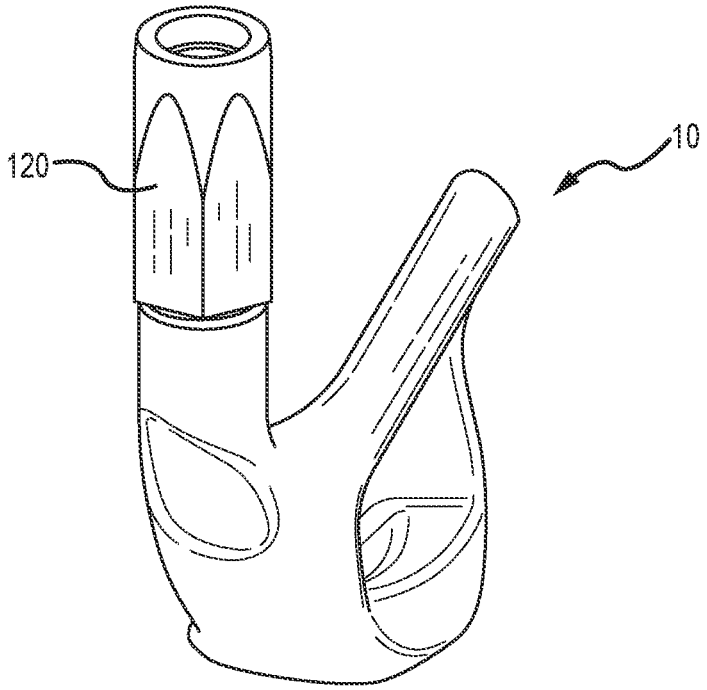
FIG. 3 illustrates a heel-side view of the alternative fitting system assembly of FIG. 1.

FIGS. 1-3 illustrate the AFS 10 comprising an adapted production club head 100, a shaft (not shown), a shaft sleeve adaptor (not shown), and a compression nut 120. FIG. 1 illustrates a front view of the AFS 10 partially assembled (shaft not shown). The compression nut 120 fits over the threaded production club head 100. The shaft sleeve adaptor is concealed within the compression nut 120. FIG. 2 illustrates a top view of the AFS 10. The compression nut 120 is sized to similarly to the hosel, except the compression nut 120 comprises external flat surfaces to allow a tool to grip the compression nut 120. As can be seen in the heel side view of FIG. 3, the external flat surfaces can extend partially along the compression nut 120. In some embodiments, such as the one illustrated, the external flat surfaces blend into a cylindrical surface near the top of the compression nut 120.

Figure 4:
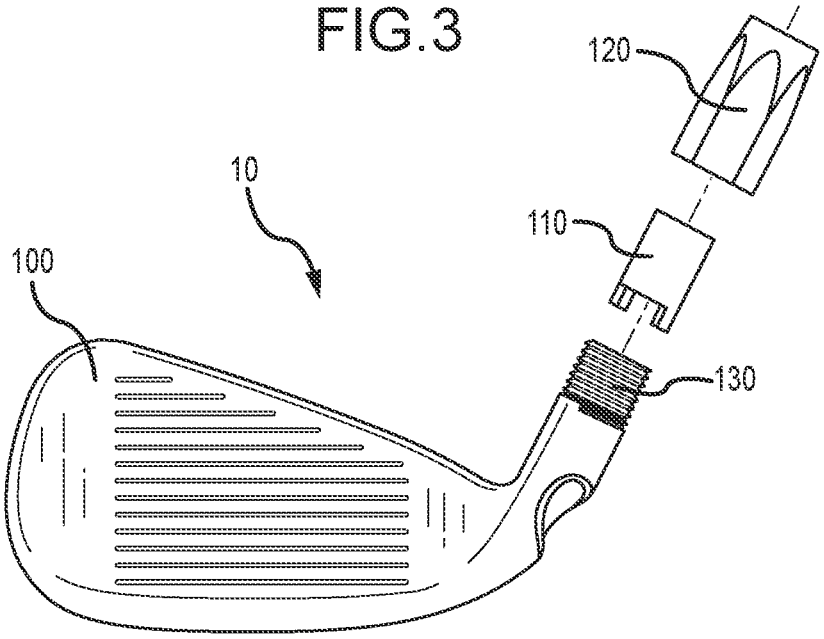
FIG. 4 illustrates a front view of the alternative fitting system assembly of FIG. 1, with components disengaged.
Figure 5:
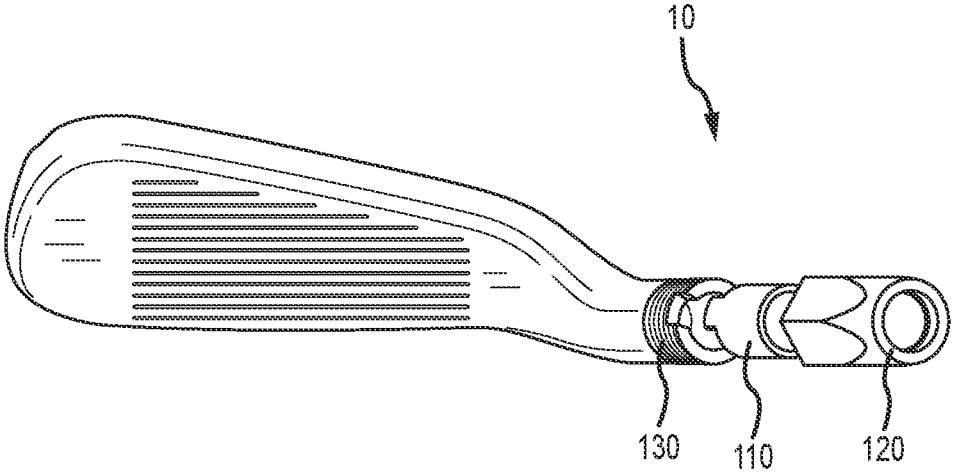
FIG. 5 illustrates a top view of the alternative fitting system assembly of FIG. 1, with components disengaged.
Figure 6:
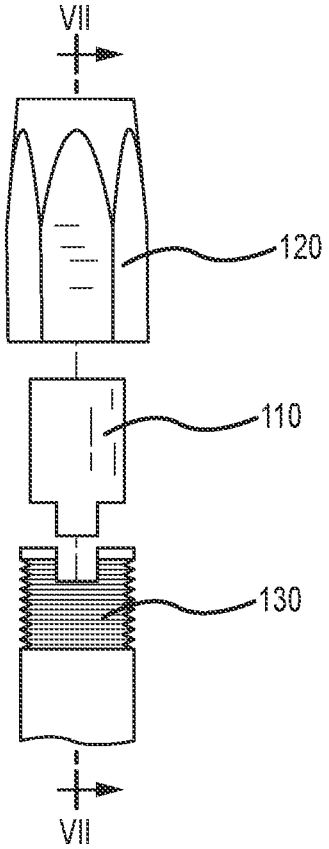
FIG. 6 illustrates a cross-section of a front view of the alternative fitting system assembly of FIG. 1, with components disengaged and excluding the main club head body.

FIGS. 4-6 further illustrate the AFS 10 with the shaft sleeve adaptor 110 shown. The adapted production club head 100 comprises a hosel 130 comprising an externally threaded portion and one or more alignment notches. The shaft sleeve adapter 110 comprises a cylindrical body, a cylindrical bore hole, one or more alignment features, a top end, and a bottom end. The compression nut 120 comprises a body and a bore hole, wherein the bore hole comprises a first top diameter portion, a second diameter portion, and a threaded portion with a third diameter.

FIG. 4 illustrates an exploded front view of the AFS 10. The top end of the shaft sleeve adaptor 110 is configured to engage a shaft (not shown). The bottom end and the one or more alignment features of the shaft sleeve adaptor are configured to coaxially engage the hosel 130 of the adapted production club head 100. The compression nut coaxially fits over the shaft sleeve adaptor 110. The shaft sleeve adaptor is received in through a bottom end of the bore hole 121 of the compression nut 120. The internal threaded portion of the compression nut 120 can engage a threaded portion of the hosel 130 to secure the shaft sleeve adaptor 110 against the hosel 130. FIG. 5 illustrates an exploded top view of the AFS 10 that further shows the alignment of the compression nut 120 with the shaft adaptor 110 and the hosel 130.

The AFS 10 is in an assembled position when the threaded portion of the compression nut 120 engages the threaded portion of the hosel 130. The AFS 10 is in a disassembled position when the threaded portion of the compression nut is disengaged with the threaded portion of the hosel.

Figure 14A:
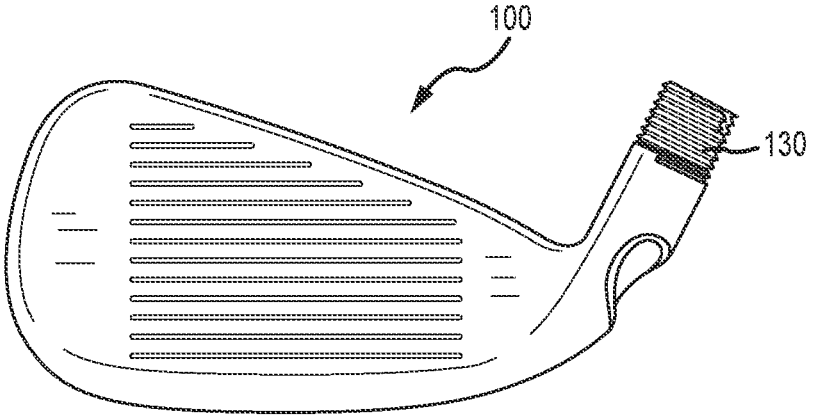
FIG. 14A illustrates a front view of a first embodiment of a production club head with a threaded hosel and alignment notches.
Figure 14B:
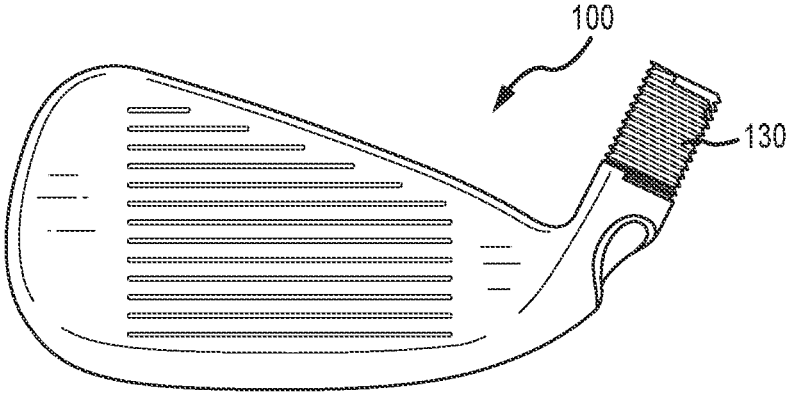
FIG. 14B illustrates a front view of a second embodiment of a production club head with a long threaded hosel and alignment notches.
Figure 14C:
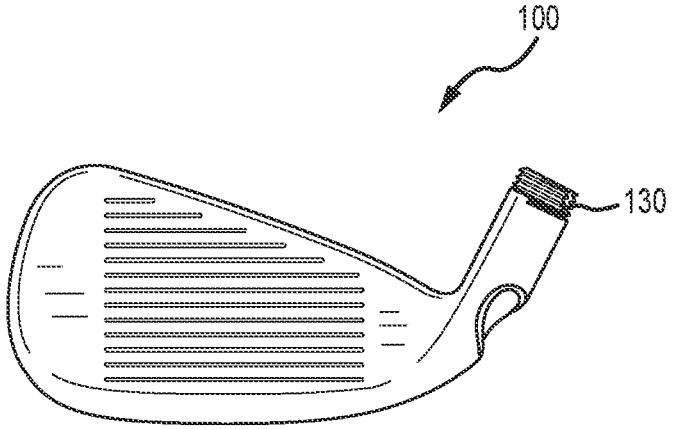
FIG. 14C illustrates a front view of a third embodiment of a production club head with a short threaded hosel and alignment notches.

As apparent in FIGS. 6-9, the production club head 100 comprises the externally threaded portion on the outside of the hosel 130. One or more alignment notches 131 can be cut into the top edge of the hosel 130. The alignment notches 131 correspond to one or more alignment features 111 on the shaft sleeve adaptor 110. The alignment notches 131 on the hosel can be square, rectangular, semi-circular, or any suitable shape. The length of the threaded part of the hosel 130 can vary between embodiments, as shown in FIGS. 14A, 14B, and 14C.

Figure 15A:
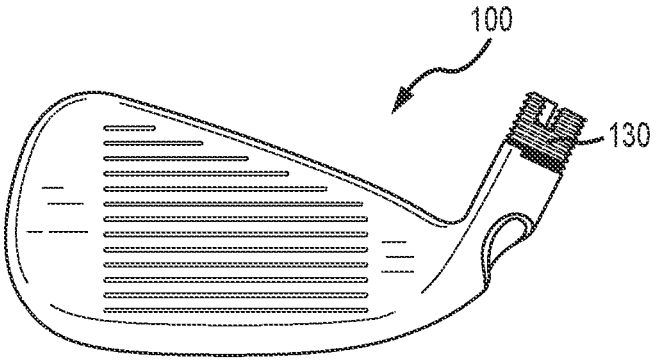
FIG. 15A illustrates a front view of a fourth embodiment of a production club head with a threaded hosel and alignment notches oriented in a first direction.
Figure 15B:
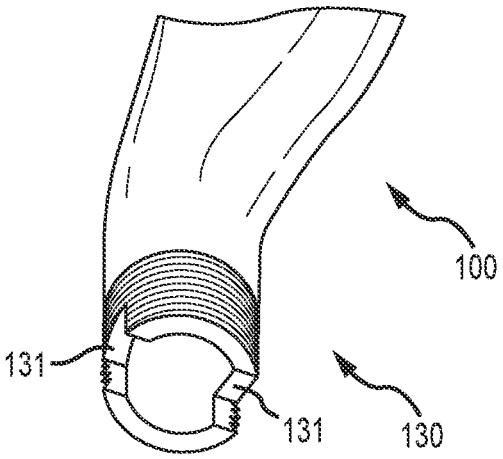
FIG. 15B illustrates a top, angled view of the club head of FIG. 15A.
Figure 16A:
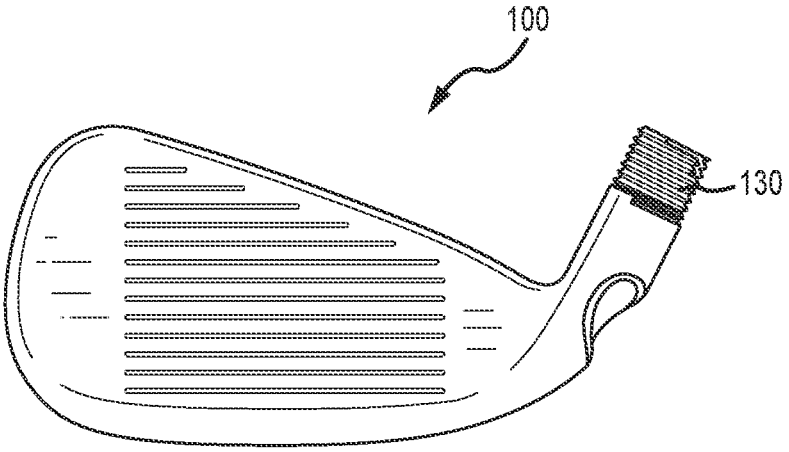
FIG. 16A illustrates a front view of a fifth embodiment of a production club head with a threaded hosel and alignment notches oriented in a second direction.
Figure 16B:
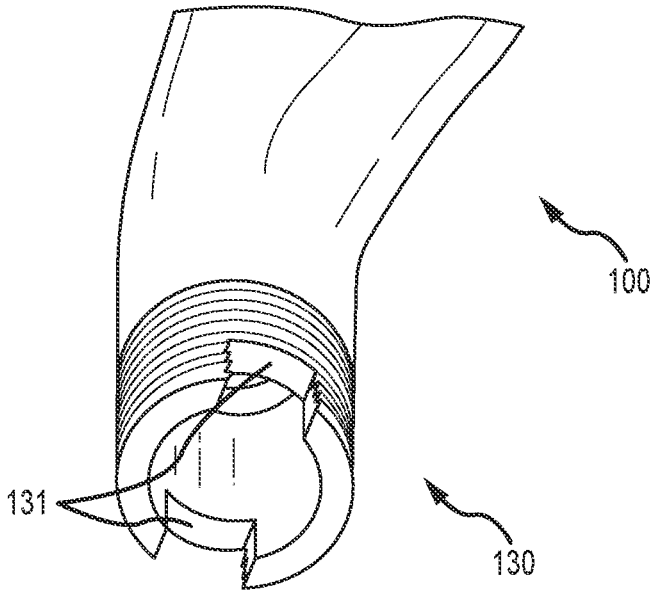
FIG. 16B illustrates a top, angled view of the club head of FIG. 16A.
Figure 17A:
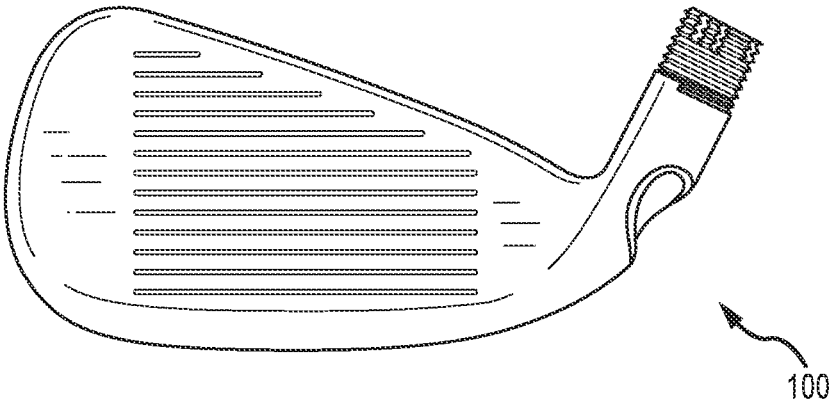
FIG. 17A illustrates a front view of a sixth embodiment of a production club head with a threaded hosel and four alignment notches.
Figure 17B:
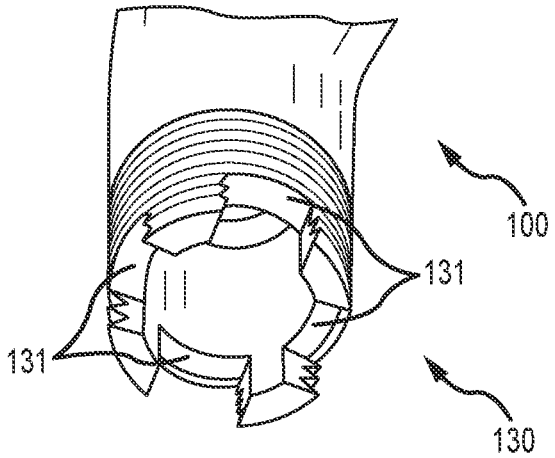
FIG. 17B illustrates a top, angled view of the club head of FIG. 17A.

Some embodiments of the adapted hosel 130 can comprise one, two, three, or four alignment notches 131. The alignment notches 131 can be oriented in a first direction, a second direction, or any suitable direction. The first direction extends generally parallel to a front-to-rear direction of the club head. The second direction extends generally parallel to a heel-to-toe direction of the club head. FIGS. 15A and 15B illustrate an embodiment with two alignment notches oriented in a first direction. FIGS. 16A and 16B illustrate an embodiment with two alignment notches oriented in a second direction. FIGS. 17A and 17B illustrate an embodiment with four alignment notches 131 wherein some alignment notches 131 are oriented in each of the first and second directions.

Figure 9:
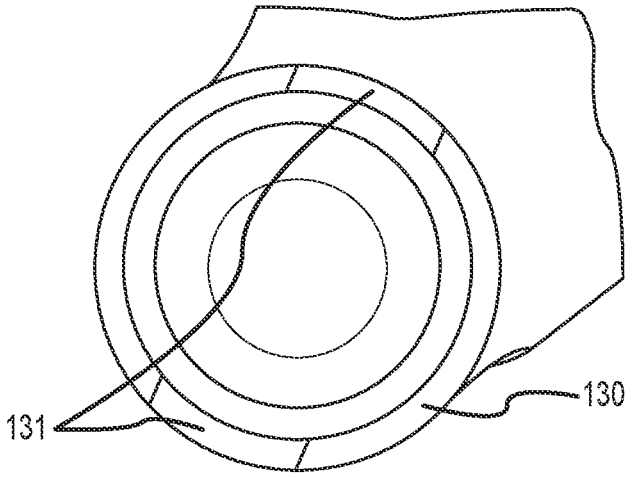
FIG. 9 illustrates a top view of the threaded hosel and shaft sleeve adapter of FIG. 8.
Figure 10A:
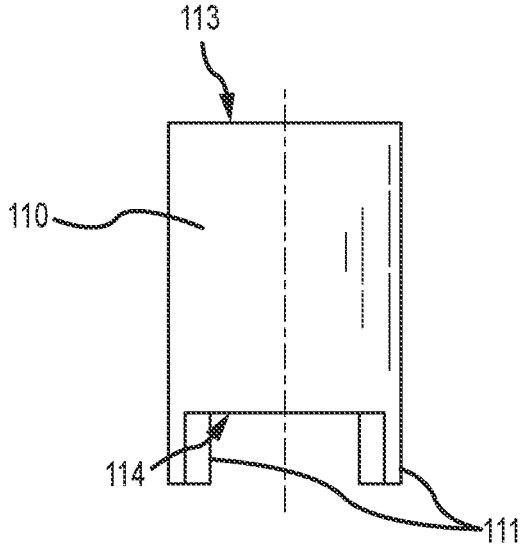
FIG. 10A illustrates a front view of the shaft sleeve adapter of the alternative fitting system assembly embodiment depicted in FIG. 1.
Figure 10B:
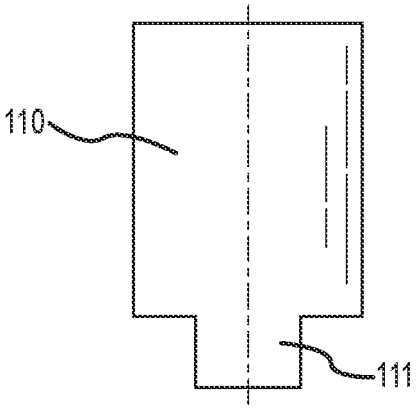
FIG. 10B illustrates a side view of the shaft sleeve adapter of the assembly alternative fitting system embodiment depicted in FIG. 1.
Figure 10C:
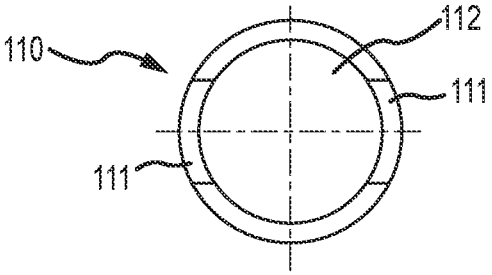
FIG. 10C illustrates a bottom view of the shaft sleeve adapter of the assembly alternative fitting system embodiment depicted in FIG. 1.

As illustrated in FIGS. 10A, 10B, and 10C, the shaft sleeve adaptor 110 comprises a cylindrical body with a cylindrical bore hole 112. The embodiment with a cylindrical body has a uniform outer diameter across the length of the shaft sleeve adaptor 110. The bore hole 112 diameter corresponds to the outer diameter of the shaft so that the shaft can fit inside the bore hole 112. Furthermore, the shaft sleeve adaptor 110 can comprise an outer diameter that fits inside the adapted hosel 130. FIG. 9 illustrates a top view of the shaft sleeve adaptor 110 inserted into the adapted hosel 130.

Figure 11A:
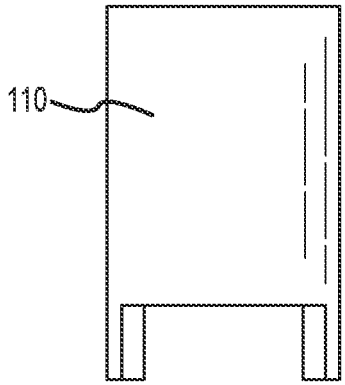
FIG. 11A illustrates a front view of a first embodiment of the shaft sleeve adapter.
Figure 11B:
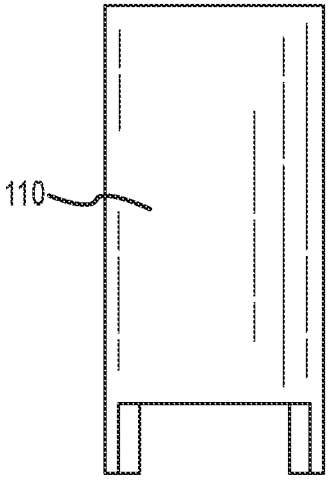
FIG. 11B illustrates a front view of a second embodiment of the shaft sleeve adapter.
Figure 11C:
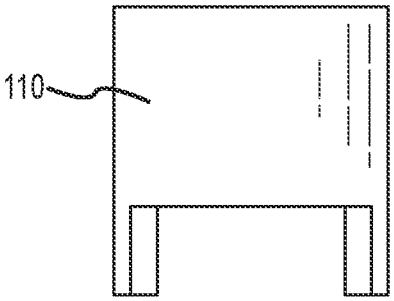
FIG. 11C illustrates a front view of a third embodiment of the shaft sleeve adapter.

The shaft sleeve adapter 110 can have various lengths as illustrated in FIGS. 11A, 11B, and 11C. The shaft sleeve adaptor 110 also comprises one or more alignment features 111 that extend downward from the shaft sleeve adaptor 110. The alignment features 111 correspond to the alignment notches 131 in the modified hosel 130. The alignment features 111 do not extend laterally outward beyond an outer surface of the cylindrical body of the shaft sleeve adapter 110.

Figure 17C:
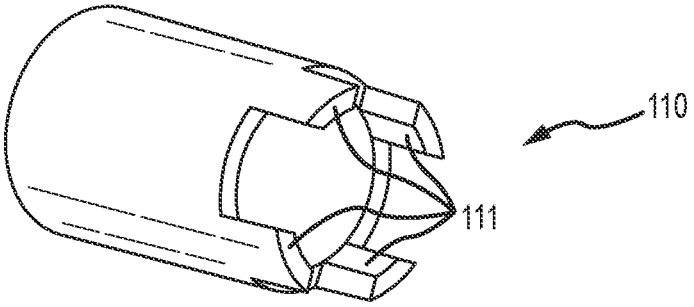
FIG. 17C illustrates an isometric view of a fifth embodiment of the shaft sleeve adapter, having four alignment notches, which corresponds to the club head of FIG. 17A.

In some embodiments, the alignment feature 111 can comprise different widths and lengths, where the width is measured as a circumferential distance with respect to the bore hole 112 and the length is measured vertically from the bottom end 114 of the shaft sleeve adapter 110 to the end of the alignment feature 111. The alignment features 111 on the shaft sleeve adaptor 110 can be square, rectangular, semicircular, or any suitable shape. The shaft sleeve adapter 110 may comprise one, two, three, or four alignment features 111. FIG. 17C illustrates an embodiment of a shaft sleeve adapter 110 with four alignment features 111. This embodiment of a shaft sleeve adapter 110 corresponds to the adapted hosel embodiment of FIGS. 17A and 17B. Some embodiments of the shaft sleeve adaptor 110 can comprise a rectangular prism body, a hexagonal prism body, or any other suitable body shape.

Figure 12:
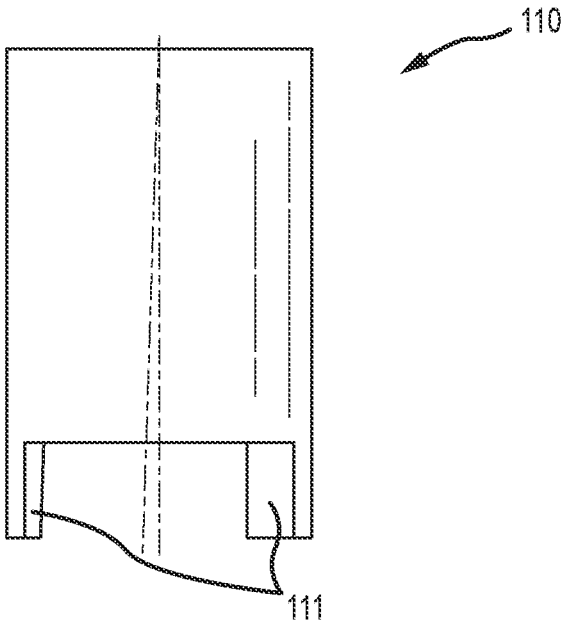
FIG. 12 illustrates a front view of a fourth embodiment of the shaft sleeve adapter, with an angled bore.

As illustrated in the embodiment of FIG. 12, the bore 112 of the shaft sleeve adaptor 110 can be produced in a tilted fashion, such that the bore 112 is not concentric with the body. The shaft sleeve adaptor 110 can comprise a variety of orientations of bore tilt. The orientation of the bore tilt will affect the adjustability of the loft and lie of the club head 100.

Figure 7:
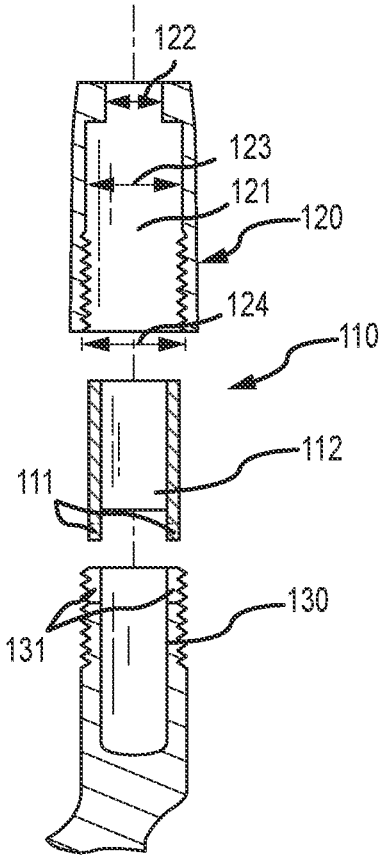
FIG. 7 illustrates a front view of the alternative fitting system assembly of FIG. 1, with compression nut disengaged and excluding the main club head body.

FIG. 6 illustrates an closeup exploded view of the AFS 10, and FIG. 7 illustrates a cross-sectional view the AFS of FIG. 6. A top diameter 122 of the compression nut 120 extends further towards the axial center of the system than the outside diameter of the shaft sleeve adaptor 110. Therefore, the top diameter portion of the compression nut 120 can press down on the shaft sleeve adaptor 110 when the compression nut 120 is threaded onto the hosel 130. A second diameter 123 of the bore hole 121 is large enough to receive the shaft sleeve adaptor 110. A third diameter 124 of the compression nut 120 is the outermost diameter of the internal threaded portion of the compression nut 120. The threaded portion of the compression nut 120 is configured to engage the adapted hosel 130.

Figure 13A:
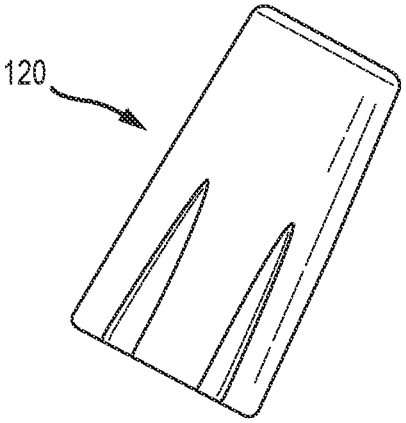
FIG. 13A illustrates a side view a first embodiment of the compression nut.
Figure 13B:
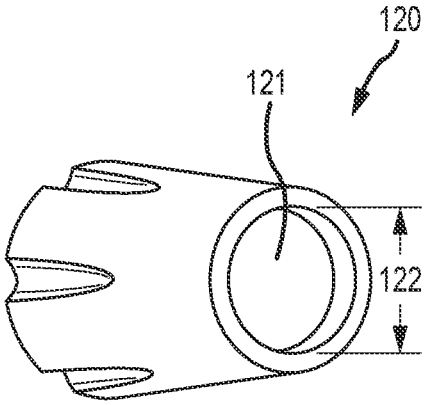
FIG. 13B illustrates an isometric view of the first embodiment of the compression nut.
Figure 13C:
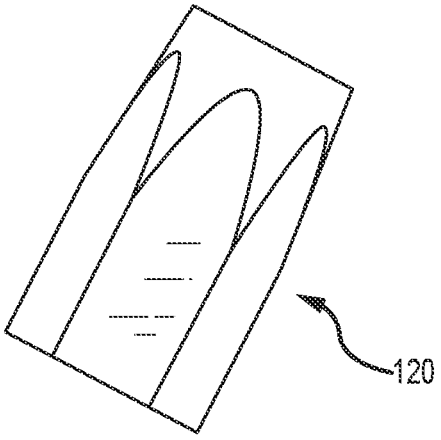
FIG. 13C illustrates a side view a second embodiment of the compression nut.
Figure 13D:
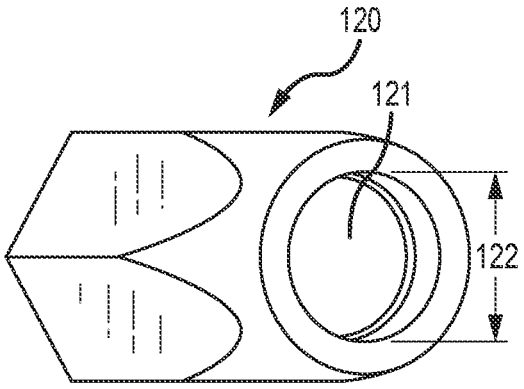
FIG. 13D illustrates an isometric view of the second embodiment of the compression nut.

FIGS. 13A and 13B illustrate the compression nut 120 which comprises a cylindrical body with a cylindrical bore hole 121 and internal threading. Some embodiments of the compression nut 120 can comprise a rectangular prism body, a hexagonal prism body, or any other suitable body shape. FIGS. 13C and 13D illustrate an embodiment of the compression nut 120 with a hexagonal prism body. As introduced above, the cylindrical bore hole 121 has multiple diameters. The top diameter 122 of the compression nut bore hole 122 corresponds to the outer diameter of the shaft. A second diameter 123 is adjacent the top diameter 122 and corresponds to the outer diameter of the shaft sleeve adapter 110. The third diameter 124 is adjacent the second diameter 123. The third diameter 124 is adjacent the bottom edge of the compression nut 120 and corresponds to the diameter of the hosel 130. When the AFS 10 is assembled, the compression nut internal threading, having the third diameter 124, engages the external threading of the hosel 130. The transition from the first top diameter 122 to the second diameter 123 creates an internal shelf.

Figure 18:
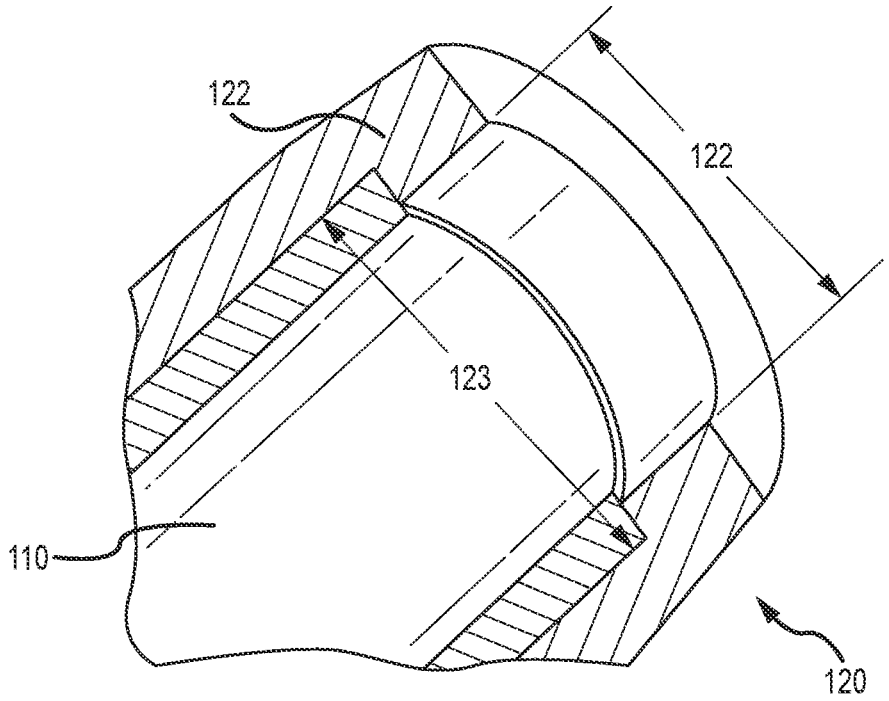
FIG. 18 partially illustrates a cross-sectional view of the engagement of the shaft sleeve adapter and compression nut of FIG. 1.

The shaft sleeve adaptor 110 is permanently adhered to the shaft by epoxy or any other suitable adhesive. The compression nut 120 slides freely up and down the shaft above the shaft sleeve adaptor 110. The compression nut 120 can extend over the shaft sleeve adaptor 110, but the internal shelf of the compression nut 120 prevents the compression nut 120 from passing fully beyond the shaft sleeve adapter 110. In this way, the compression nut 120 remains on the shaft when the AFS is disassembled. As illustrated in FIG. 18, when the AFS is assembled, the internal shelf of the compression nut 120 presses against the top end 113 of the shaft sleeve adapter 110 and keeps the shaft sleeve adapter 110 engaged with the hosel 130. When the AFS is assembled, the shaft sleeve adapter 110 can be concealed by the compression nut 120. When the AFS is disassembled, the shaft sleeve adapter 110 is visible.

Figure 8:
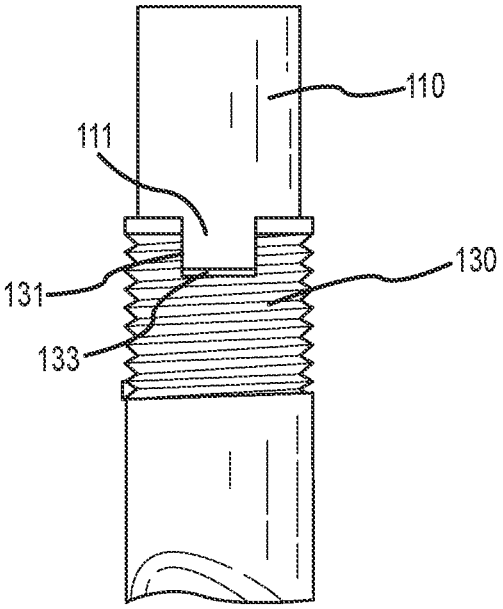
FIG. 8 illustrates a close-up view of the threaded hosel and a shaft sleeve adapter included in FIG. 7.

As illustrate in FIG. 8, when the shaft of the club is placed into the hosel 130 of the club head, the alignment notches 131 on the hosel 130 and the alignment features 111 on the shaft sleeve adaptor 110 are matched up. The engagement of the alignment notches 131 with the alignment features 111 prevents the head 100 from rotating independently of the club shaft. To secure the shaft to the club head 100, the compression nut 120 can be threaded onto the hosel threads 130 so that the club head 100 is removably fixed to the shaft. As illustrated in FIG. 8, the assembly is designed such that a small gap 133 is left between the one or more alignment features 111 and the one or more alignment notches 131, to ensure that the main bottom end 114 of the shaft sleeve adapter 110 and the top surface of the hosel 130 are securely contacting each other when the compression nut 120 is threaded onto the adapted hosel 130.

In the AFS assembly 10, when the embodiment with the tilted bore in the shaft sleeve adaptor 110 is implemented, the hosel bore is not concentric with the club shaft. The orientation of the shaft tilt relative to the hosel bore can allow either the loft or lie of the club to change when the shaft is rotated and re-attached. In some embodiments, the AFS allows a number of possible loft and lie angle orientation combinations, wherein the possible combinations can form a matrix with a plurality of rows and a plurality of columns. There can be one or two possible loft angle orientations, and one or two possible lie angle orientations. Thus the matrix of possible combinations can be a 1×1, 1×2, 2×1, or 2×2 matrix.

By directly turning threads on existing production heads, the cost of the AFS is lowered. Current golf club head products can be used in the AFS system, which eliminates the need to create custom AFS club heads that are useful only with the AFS. A hosel adapter is not required in the AFS. Weight is saved by directly connecting the compression nut 120 to the adapted production club head hosel 130. Current available fitting systems add approximately 9 to 12 grams of weight over the actual product weight. The AFS 10 described above only adds 6 grams of weight, making it significantly better for simulating how a player will swing with a production club. The simplicity of this invention allows it to be implemented on any iron, wedge, crossover, or other related club head. The ability to adjust loft and lie can also lower AFS costs and speed the fitting process by eliminating the need to change heads for every loft or lie adjustment.

The AFS 10 can be manufactured by first providing a production club head 100, a shaft, a shaft sleeve adaptor 110, and a compression nut 120. The production club head 100 can be formed in ways known in the art for producing club heads. The shaft can also be produced in ways known in the art. The shaft sleeve adaptor 110 and the compression nut 120 can be cast, molded, machined, formed using additive manufacturing, or formed through a combination of the above methods. After the components are provided for the AFS 10, the production club head 100 is modified. To modify the production club head 100, the external of the hosel is threaded. Next, alignment notches 131 are cut, ground, or stamped out of the top of the threaded hosel 130. Some additional machining may be necessary to clean up and finish the hosel so that it is prepared to engage the remaining components of the AFS 10.

The method of manufacturing the AFS 10 further comprises placing the compression nut 120 on the shaft and adhering the shaft sleeve adaptor 110 to the shaft. The compression nut 120 must first be slid onto the shaft because once the shaft sleeve adaptor 110 is secured to the end of the shaft, the compression nut 120 can be neither placed on or removed from the shaft. A full AFS set will comprise multiple AFS shafts and multiple modified production club heads 100. Therefore, to produce a full AFS set, the above method of manufacturing the AFS 10 must be repeated for various lofts and lies of club heads. The method can also include outfitting various lengths of shafts and various flexibilities of shafts with compression nuts and shaft sleeve adaptors.

Figure 19:
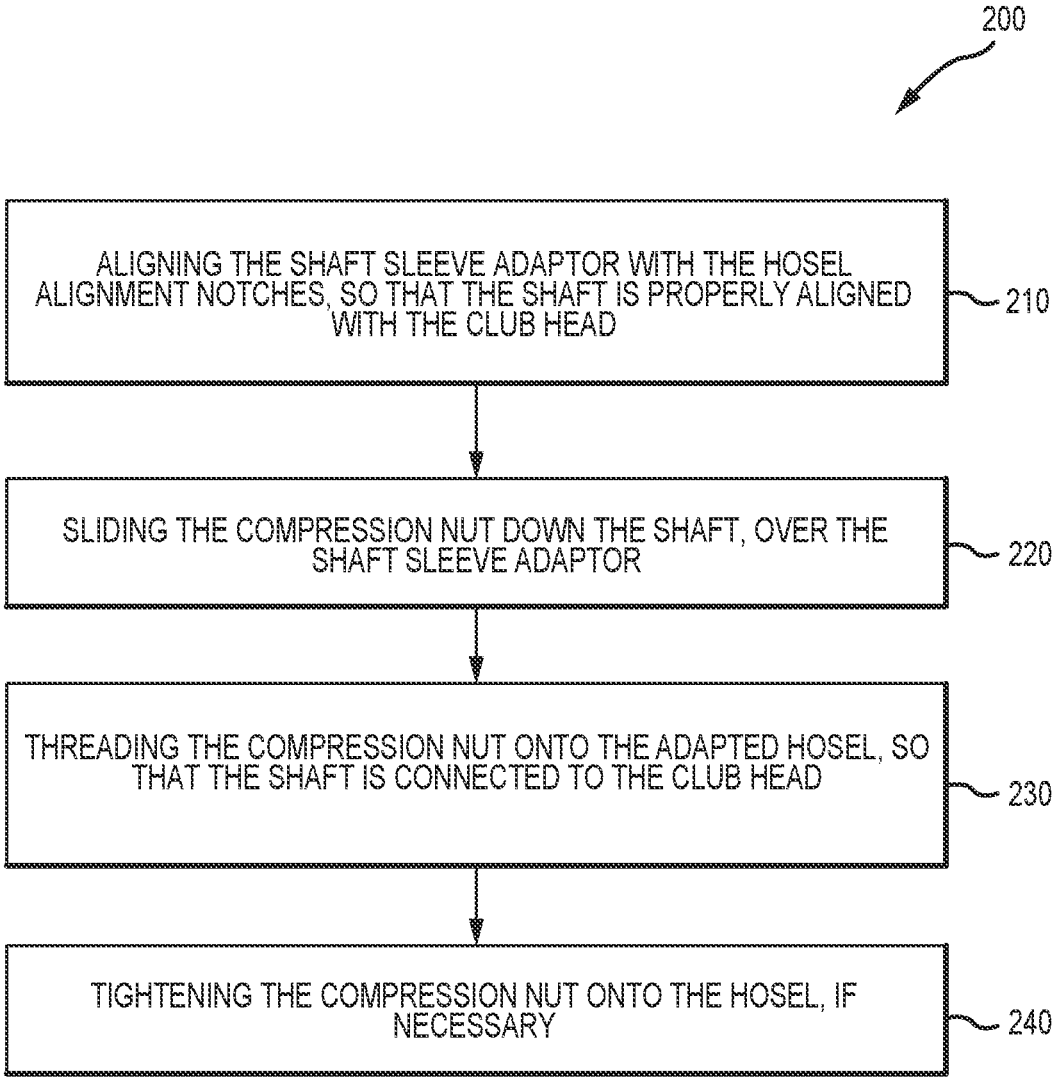
FIG. 19 illustrates a method of assembling an alternative fitting system, according to an embodiment.

As illustrated in FIG. 19, a method 200 of a assembling an AFS golf club head from any AFS shaft and any AFS adapted production club head 100, comprises the following steps: (step 210) aligning the shaft sleeve adaptor 110 of the shaft with the hosel alignment notches, so that the shaft is properly aligned with the club head 100; (step 220) sliding the compression nut 120 down the shaft, over the shaft sleeve adaptor 110; (step 230) threading the compression nut 120 onto the adapted hosel 130; and (step 240) tightening the compression nut 120 onto the hosel 130, if necessary. In step 240, a tool can be used to tighten the compression nut 120 onto the hosel 130. To disassemble the AFS, the assembly process is reversed, as described below.

Figure 20:
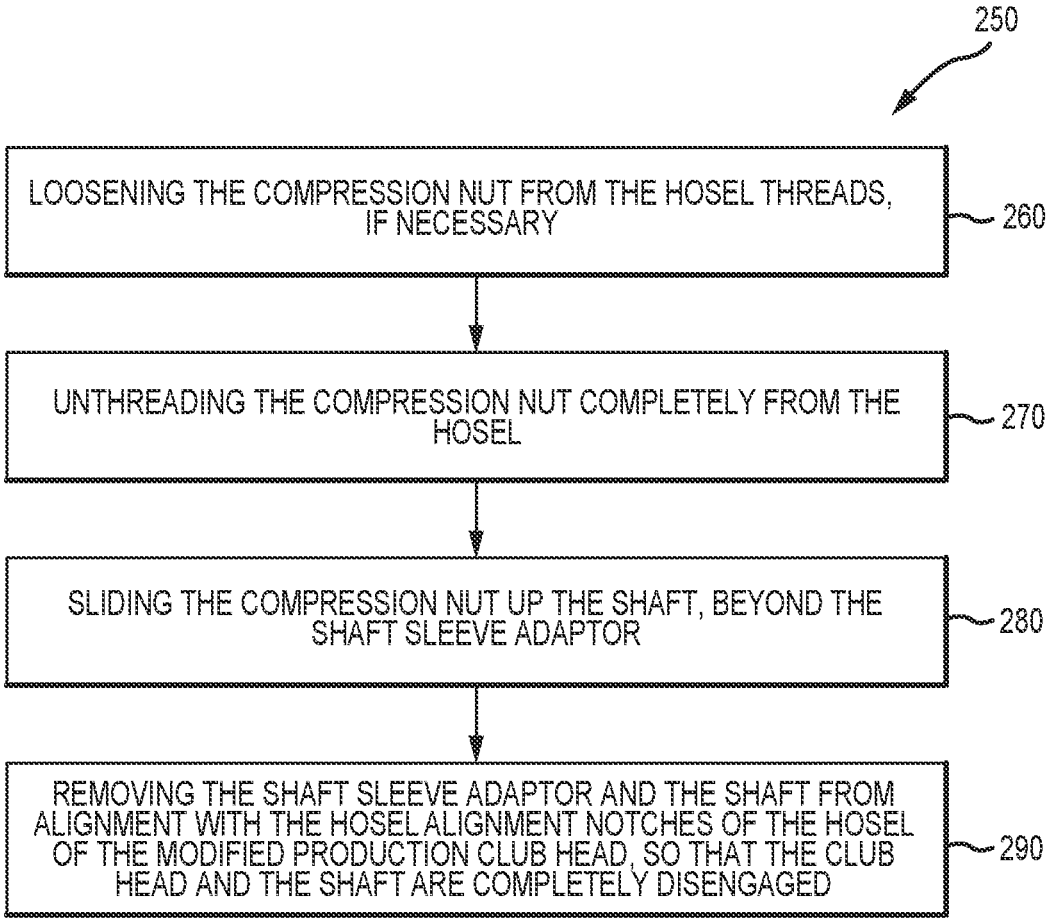
FIG. 20 illustrates a method of disassembling an alternative fitting system, according to an embodiment.

As illustrated in FIG. 20, a method 250 of disassembling the AFS, comprises the following steps: (step 260) loosening the compression nut 120 from the hosel threads, if necessary, (step 270) unthreading the compression nut 120 completely from the hosel 130, (step 280) sliding the compression nut 120 up the shaft, beyond the shaft sleeve adaptor 110, and (step 290) removing the shaft sleeve adaptor 110 and the shaft from alignment with the hosel alignment notches of the hosel of the modified production club head 100. In some embodiments, a tool is employed to in step 260 to help loosen the compression nut 120 from the threads of the hosel 130.

The AFS 10 design can be employed across a set of iron-type club heads to create a plurality of modified production club heads. Each club head of the plurality of modified production club heads can comprise a different loft. For example, the club heads can comprise lofts selected from the group consisting of 19°, 20°, 21°, 22°, 23°, 24°, 25°, 26°, 27°, 28°, 29°, 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53° 54°, 55°, 56°, 57°, 58°, 59°, 60°, 61°, 62°, 63°, and 64°. The plurality of modified production golf club heads can comprise iron-type club heads selected from the group consisting of: 2 irons, 3 irons, 4 irons, 5 irons, 6 irons, 7 irons, 8 irons, 9 irons, and wedges. In some embodiments, each club head can also comprise a different lie angle. Each club head of the plurality of modified production golf club heads comprises one or more alignment notches and an external threaded portion, as described above for the AFS 10.

Additionally, a plurality of modified shafts can be provided according to the AFS 10 design. Each club head of the plurality of modified shafts can comprise a different stiffness. For example, the plurality of modified shafts can comprise shafts with stiffnesses selected from the group consisting of: extra stiff flex, stiff flex, regular flex, senior flex, and ladies flex. Each shaft of the plurality of modified shafts comprises a compression nut slidably engaged with each shaft and a shaft sleeve adaptor secured to a tip end of each shaft.

A method of fitting a golfer can include providing an AFS with a plurality of modified production club heads and a plurality of modified shafts. A first golf club can be constructed from one of the plurality of modified production club heads (a first club head) and one of the plurality of modified shafts (a first shaft). Fitting the golfer requires the golfer to then strike a golf ball with the first golf club. Next, a second golf club can be constructed by either switching out the first club head or the first shaft of the first club head. For example, after the first golf club is disassembled, the second golf club head can be constructed by assembling the first club head with a second shaft having a different stiffness than the first shaft. In an alternate example, after the first golf club is disassembled, the second golf club head can be constructed by assembling a second club head having a different loft and/or lie with the first shaft.

In one example method of fitting, a first golf club is assembled from a first club head and a first shaft. A second golf club is assembled from the first club head and a second shaft. A third golf club is assembled from a second club head and the first shaft. A fourth golf club is assembled from the second club head and the second shaft. The method of fitting a golfer further comprises the golfer swinging each club (first, second, third, and fourth) when each club is assembled. Finally, the method comprises isolating the most suitable club for the golfer's swing from the first, second, third, and fourth golf clubs. The most suitable AFS assembled club can be used to determine the golfer's club specifications, which can be used when purchasing or using production golf clubs.

In some embodiments of the fitting method, a second plurality of shafts is provided, wherein each of the shafts of the second plurality of shafts comprises a length different from the length of each of the shafts of the first plurality of shafts. Pairing one of the second plurality of shafts with one of the plurality of club heads modifies the length of the shaft of the resulting golf club.

Using the plurality of AFS modified production club heads and the first and second pluralities of modified shafts, a club head having any combination of shaft stiffness, shaft length, and loft can be constructed. If it is determined that a certain parameter is desirable for the golfer, that parameter can be held constant while the other parameters are varied. For example, after determining that a specific shaft length is desirable for the golfer, the shaft length can be held constant while the loft and stiffness are varied. If, for example, a desirable stiffness is further isolated, then the desirable loft and/or lie can be determined by keeping the same shaft and changing out club heads until the desirable loft and/or lie is isolated.

We claim:

1. A golf club alternative fitting system consisting of a club head, a golf club shaft, a shaft sleeve adapter, and a compression nut; wherein:

the club head comprises a hosel comprising an externally threaded portion, a top surface, a hosel bore, and one or more alignment notches;

wherein the hosel bore is not concentric with the golf club shaft the shaft sleeve adapter comprises a cylindrical body, a cylindrical borehole, one or more alignment features, a top end, and a bottom end;

wherein the cylindrical body comprises a uniform outer diameter from the top end to the bottom end;

wherein the one or more alignment features extend downward from the bottom end of the shaft sleeve adapter to define a bottom surface of the one or more alignment features;

wherein the one or more alignment features do not extend laterally outward beyond an outer surface of the cylindrical body;

the compression nut comprises a body and a borehole, wherein the borehole comprises a top diameter portion, a second diameter portion, and a threaded portion with a third diameter wherein:

the one or more alignment notches are configured to receive the one or more alignment features when the golf club alternative fitting system is in an assembled configuration;

there is a gap between the bottom end of the one or more alignment features and the one or more alignment notches to ensure contact between the bottom end of the shaft sleeve adapter and the top surface of the hosel when the one or more alignment features are received by the one or more alignment notches; and the threaded portion of the compression nut is configured to engage the externally threaded portion of the hosel.

2. The golf club alternative fitting system of claim 1 wherein:

the golf club alternative fitting system is in the assembled configuration when the threaded portion of the compression nut engages the threaded portion of the hosel; and the golf club alternative fitting system is in a disassembled configuration when the threaded portion of the compression nut is disengaged with the threaded portion of the hosel.

3. The golf club alternative fitting system of claim 2, wherein:

the shaft sleeve adapter is concealed from view when the golf club alternative fitting system is in the assembled configuration; and the shaft sleeve adapter is visible when the golf club alternative fitting system is in the disassembled configuration.

4. The golf club alternative fitting system of claim 1, wherein the alignment notches are square.

5. The golf club alternative fitting system of claim 1, wherein the alignment notches are rectangular.

6. A golf club alternative fitting system comprising a club head, a golf club shaft, a shaft sleeve adapter, and a compression nut; wherein:

the club head comprises a hosel comprising an externally threaded portion, a top surface, and two or more alignment notches;

the shaft sleeve adapter comprises a cylindrical body, a cylindrical borehole, two or more alignment features, a top end, and a bottom end;

wherein the cylindrical body comprises a uniform outer diameter from the top end to the bottom end;

wherein the one or more alignment features do not extend laterally outward beyond an outer surface of the cylindrical body;

the compression nut comprises a body and a borehole, wherein the borehole comprises a top diameter portion, a second diameter portion, and a threaded portion with a third diameter;

the two or more alignment notches of the hosel are configured to receive the two or more alignment features of the shaft sleeve adapter with a gap separating a bottom end of the one or more alignment features and the one or more alignment notches to ensure contact between the bottom end of the shaft sleeve adapter and the top surface of the hosel; and the threaded portion of the compression nut is configured to engage the externally threaded portion of the hosel.

7. The golf club alternative fitting system of claim 6, wherein:

the two or more alignment notches of the hosel are lined up parallel to a heel-to-toe direction of the club head.

8. The golf club alternative fitting system of claim 6, wherein:

the two or more alignment features of the shaft sleeve adapter comprises four alignment features;

the two or more alignment notches in the hosel of the club head comprise four alignment notches; and the four alignment notches of the hosel are configured to receive the four alignment features of the shaft sleeve adapter.

9. The golf club alternative fitting system of claim 6, wherein:

the club head is manufactured from a production club head, wherein the production club head is configured to either be permanently attached to a shaft to form a traditional golf club or be incorporated into the golf club alternative fitting system.

10. A method of manufacturing a golf club alternative fitting system comprising:

providing a production club head, a golf club shaft, a shaft sleeve adapter, and a compression nut; wherein:

the production club head is configured to either be permanently attached to a shaft to form a traditional golf club or be incorporated into the golf club alternative fitting system;

the production club head comprises a hosel;

the shaft sleeve adapter comprises a cylindrical body having a uniform outer diameter and, a cylindrical bore hole, one or more alignment features, a top end, a bottom end; and wherein the one or more alignment features do not extend laterally outward beyond an outer surface of the cylindrical body;

the compression nut comprises a body and a borehole, wherein the borehole comprises a top diameter portion, a second diameter portion, and a threaded portion with a third diameter;

modifying the production club head; wherein modifying the production club head comprises threading an outside surface of the hosel and cutting one or more alignment notches into the hosel;

wherein the one or more alignment notches are configured to receive the one or more alignment features when the golf club alternative fitting system is in an assembled configuration; and wherein there is a gap between a bottom end of the one or more alignment features and the one or more alignment notches to ensure contact between the bottom end of the shaft sleeve adapter and a top surface of the hosel when the one or more alignment features are received by the one or more alignment notches;

wherein the threaded portion of the compression nut is configured to engage the threading on the outside surface of the hosel;

placing the shaft sleeve adapter onto the golf club shaft; and securing the shaft sleeve adapter to a tip end of the golf club shaft.

11. The method of manufacturing a golf club alternative fitting system of claim 10, wherein:

the golf club alternative fitting system is in an assembled configuration when the threaded portion of the compression nut engages the threaded portion of the hosel; and the golf club alternative fitting system is in a disassembled configuration when the threaded portion of the compression nut is disengaged with the threaded portion of the hosel.

12. The method of manufacturing a golf club alternative fitting system of claim 10, wherein:

the one or more alignment features may be oriented in a first direction or in a second direction;

wherein the first direction extends generally parallel to a front-to-rear direction of the production club head and the second direction extends generally parallel to a heel-to-toe direction of the production club head.

13. The method of manufacturing a golf club alternative fitting system of claim 10, wherein:

securing the shaft sleeve adapter to the shaft comprises gluing the shaft sleeve adapter to the shaft with an adhesive.

14. The method of manufacturing a golf club alternative fitting system of claim 10, wherein:

in a disassembled configuration the compression nut is slidably positioned on a tip end of the golf club shaft; and the shaft sleeve adapter prevents the compression nut from sliding off the tip end of the golf club shaft.

15. The method of manufacturing a golf club alternative fitting system of claim 10, wherein:

the top diameter portion of the compression nut comprises a top diameter that is less than a maximum diameter of the shaft sleeve adapter; and the top diameter is sized to receive the golf club shaft.

16. The method of manufacturing a golf club alternative fitting system of claim 10, wherein:

providing the shaft sleeve adapter comprises providing two alignment features on the shaft sleeve adapter; and modifying the production club head comprises cutting two alignment notches into the hosel of the production club head; and the two alignment notches of the hosel are configured to receive the two alignment features of the shaft sleeve adapter.

* * * * *